US006375190B1

(12) United States Patent
Kocher

(10) Patent No.: US 6,375,190 B1
(45) Date of Patent: Apr. 23, 2002

(54) DOUBLE-HIT BLACKJACK

(76) Inventor: Robert William Kocher, 4828 3rd St. North, Arlington, VA (US) 22203

( * ) Notice: Subject to any disclaimer, the term of this patent is extended or adjusted under 35 U.S.C. 154(b) by 0 days.

(21) Appl. No.: 09/676,564

(22) Filed: Oct. 2, 2000

(51) Int. Cl.[7] ..... A63F 1/00

(52) U.S. Cl. ..... 273/303; 273/292; 273/274; 463/12

(58) Field of Search ..... 273/303, 292, 273/274; 463/12

(56) References Cited

U.S. PATENT DOCUMENTS 5,288,081 A * 2/1994 Breeding ..... 273/292
5,407,199 A * 4/1995 Gumina ..... 273/139
5,984,308 A * 11/1999 Herrmann
6,070,873 A * 6/2000 Perkins ..... 273/292
6,070,875 A * 6/2000 Boylan et al. ..... 273/292
6,077,162 A * 6/2000 Weiss ..... 463/26
6,095,525 A * 8/2000 Terminel
6,206,375 B1 * 3/2001 Wichinsky

OTHER PUBLICATIONS

Gibson, "Hoyle's Modern Encyclopedia of Card Games", 1974, pp. 32 to 35.*

* cited by examiner

*Primary Examiner*—Jeanette Chapman
*Assistant Examiner*—Nini F. Legesse

(57) ABSTRACT

This invention adds new excitement to a blackjack type of game allowing the player holding a poor hand more options and chances to gamble for higher returns. The invention allows the player to take two cards ("double-hit") or three cards ('triple-hit') and if the player does not go over 21 and beats the dealer, the player receives odds on the original bet. Alternate versions include allowing the player to double his bet or decrease the original bet in half. Also within this scope of this invention is keeping the original bet, varying the original bet and/or receiving odds against the original bet depending on the number of cards declared.

7 Claims, 2 Drawing Sheets

DOUBLE-HIT BLACKJACK

CROSS REFERENCE TO RELATED APPLICATIONS

Not Applicable

STATEMENT REGUARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to methods of playing games and methods of amusement.

2. State of the Art

The card game of Blackjack is commonly played in casinos throughout the world. The game has standard rules, which allow players to understand the odds and play in any casinos. A Las Vegas visitor typically wanders from casino to casino faced with large rooms of blackjack tables. The game is generally the same, only the casino name changes. Various patents attempt to modify the rules to add diversity. Many of the patented games have not been successfully implemented primarily because the visiting gamblers don't want to take the time to learn the game and are unsure of the new game's odds and player's strategy. Casinos need to attract more customers. This has lead in the rise of offering new games, typically involving a side bet.

Blackjack typically allows modifying the original bet after the first set of cards is dealt. The most common post initial dealing rules are 'doubling down', 'insurance' or 'surrendering'. 'Doubling down' involves doubling the original bet and taking one card down and standing pat on the hand. 'Insurance' is an option when the dealer is showing an ace and the players are offered the opportunity to insure up to one-half of their bet by betting that the dealer has a 10 or face card as the down card. 'Surrendering' is used when the dealer is showing an excellent hand such as a face card, 10 or ace and the player has a very poor hand such as a sum of 14, 15, or 16. 'Doubling down' is typically recommended when the player has an excellent hand, such as a 9, 10, face card or ace and the dealer is showing a 2,3,4,5, or 6. The challenge is inventing a new, interesting, and easily understood method of 21. These post initial deal rules allow more options for the player thereby making the game more interesting and potentially giving the player better odds. But these rules have been widely adopted and no longer add to the excitement or novelty of the game.

SUMMARY

This invention allows for the player to examine his dealt hand of two cards then comparing his hand to the dealer's face-up card, the player is allowed to keep or modify his initial bet and draw a mandatory two cards. This invention adds new interest, is easily understood, and potentially allows better odds for the player or house depending on the selected odds ratio.

One aspect of this invention is a method of playing cards between a dealer and at least one player where the player may modify his original bet, such as double the original bet, then take a mandatory two cards and stand on the hand. If the player beats the dealer using traditional Blackjack rules, the player would be paid the traditional matching 1:1 or more and if the dealer ties the player, the player would traditionally 'push' or receive his original bet back.

Another aspect of this invention is a method of playing cards between a dealer and at least one player where the player may modify his original bet, such as cut-in-half the original bet, then take a mandatory two cards and stand on the hand. If the player beats the dealer using traditional Blackjack rules, the player would be paid the traditional matching 1:1 or better odds and if the dealer ties the player, the player would traditionally 'push' or receive his original bet back.

DRAWING FIGURES

LIST OF REFERENCE NUMERALS

Item 1 provides playing cards

Item 2 establishes card values in accordance with standard Blackjack rules

Item 3 is the start of the game after bets are placed

Item 4 is each player and dealer-banker gets the initial two cards

Item 5 is the double hit Blackjack options in addition to traditional Blackjack rules Item 6 is the value of the player's cards after the two additional cards have been dealt Item 7 is if the player did not exceed 21 with the 4 cards total Item 8 is a winner if the player beats the dealer after the dealer takes his cards in accordance with standard Blackjack rules.

Item 9 is if the player's hand exceeds the sum of 21

Item 10 is if the player does not beat the dealer's hand

Item 11 is if the player and dealer have the same sum "a push"

Item 12 is the standard Blackjack table

Item 13 is a player's seat

Item 14 is the player's betting position or betting box

DESCRIPTION-MAIN EMBODYMENT

The invention of the Double-Hit Blackjack is used when the player has a poor hand and the dealer has an excellent hand. For example if the dealer is showing a 7, 8, 9, 10, face card, or ace and the player has a total of 4, 5, or 6, the current strategy recommends that the player take at least two cards.

Figure 1:
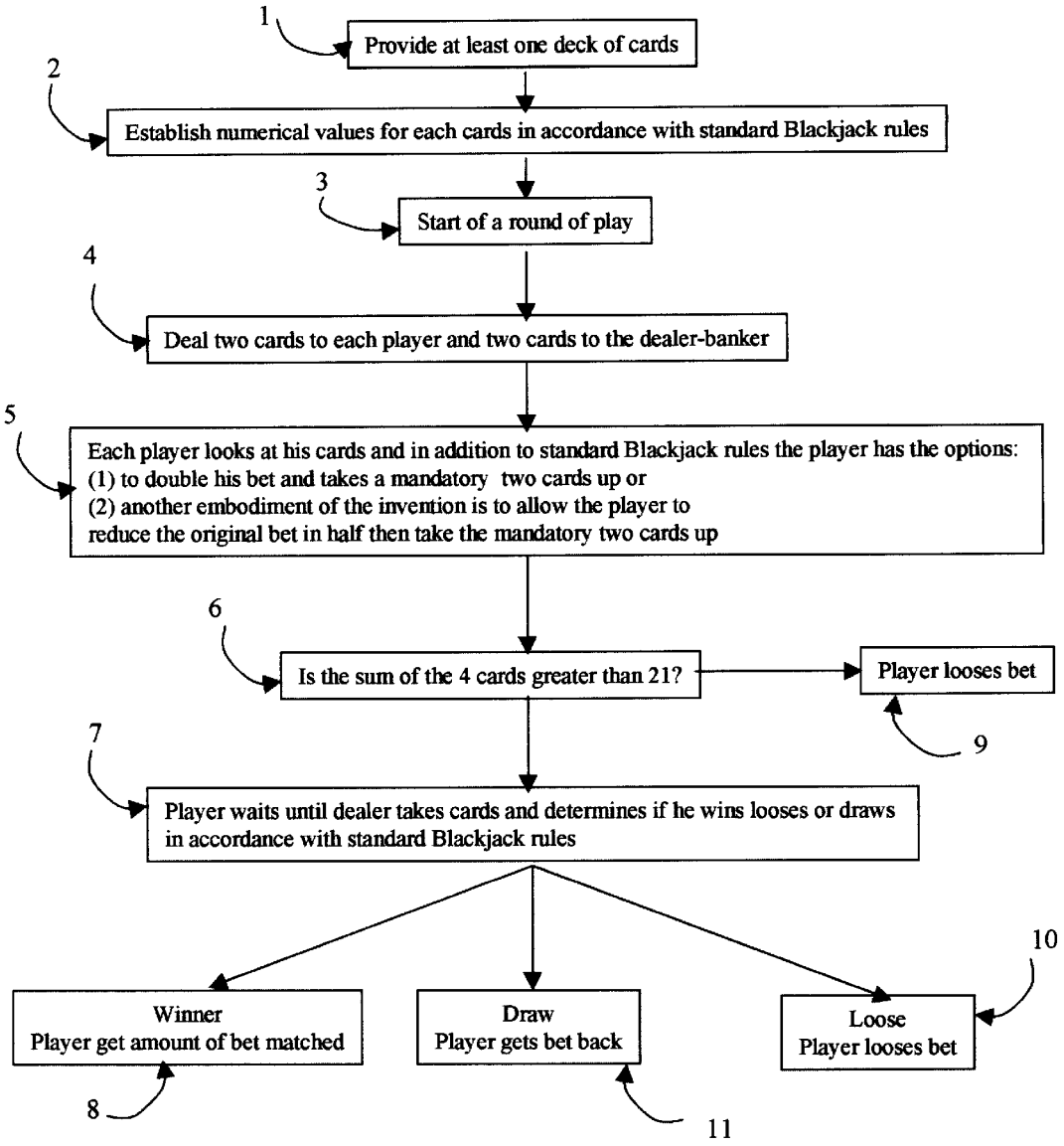
FIG. 1 shows a block diagram of the main embodiment of the Double Hit Blackjack method.
Figure 2:
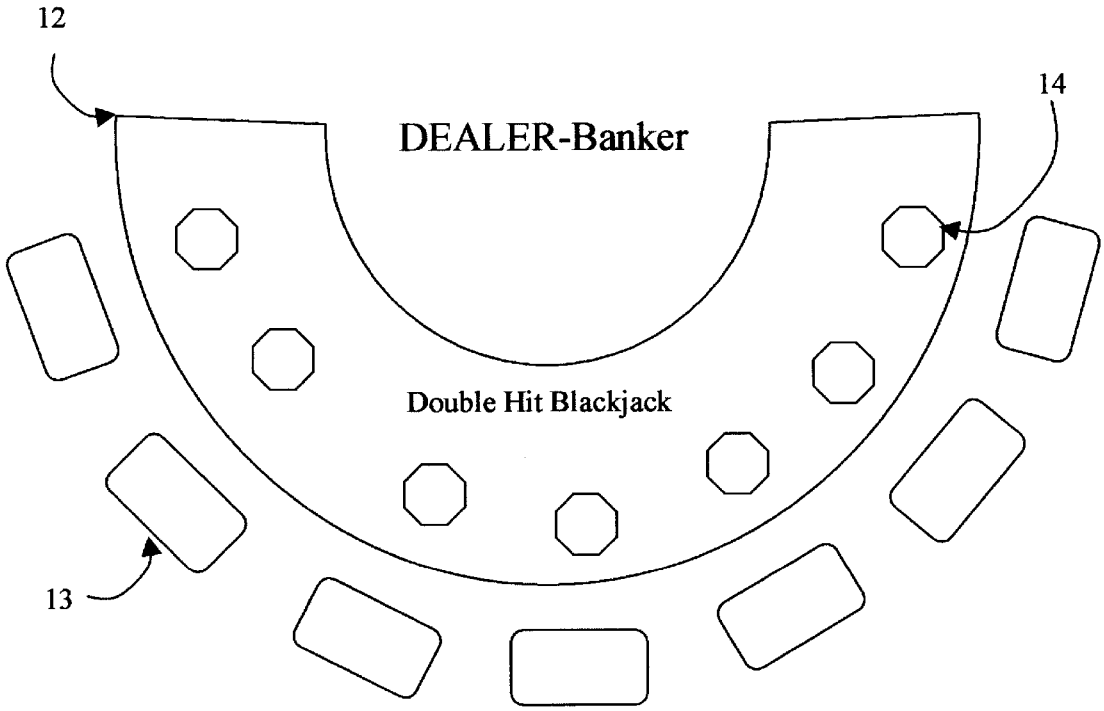
FIG. 2 is one preferred type of a playing table layout.

FIG. 2 shows the game table 12, the player positions and seats 13 and the betting positions or bet boxes 14. FIG. 1 shows the overall process, which begins with the basic Blackjack game, starting with a deck of cards 1 with traditional Blackjack values for numbered cards, face cards, and aces 2. The players place their bets and the round starts 3. Two cards are dealt to each player and two cards to the dealer 4. Each player looks at his cards 5. The player's options include the standard Blackjack options such as stand pat with the cards dealt, double down, split pairs, or the standard hit. The player's decision is based on his cards in relationship to dealer's face up card. If the player has a poor hand such a sum of 4, 5, 6, or 12, 13, 14, 15, or 16, the player will take different actions based on what the dealer is showing. Double-Hit Blackjack adds several optional rules based on the casino's view if double hitting will help their odds of winning. Option 1 involves using 'Double-Hit' to allow the player to double his bet and take two cards face up 6. If he busts, he is out 9. If his cards total has less than 22, he can stay and play through until the dealer determines his final hand's total 7. Another embodiment is Option 2 involving using 'Double-Hit' to protect a bet 5 by allowing the player to remove one-half of his bet and take two cards face up 6. If he busts, he is out 9. If his cards total has less than 22, he can stay and play through until the dealer determines his final hand's total 7. In accordance with standard Blackjack rules a winner 8 is declared if the player has more than the dealer and less than 22 and the player receives a match of the amount of money in the bet box 14. If the player and dealer match point sums draw 11, then the player gets the amount remaining in the bet box 14 back. If the dealer's hand is greater than the player's hand and less than 22, 10 the player looses the amount of money in the bet box 14.

DESCRIPTION AND OPERATION-ALTERNATIVE EMBODIMENTS

Alternate embodiments include allowing only the doubling of a bet prior to taking the Double-Hit. Another embodiment would be only allowing the reducing of a bet by one-half prior to taking the Double-Hit. Another embodiment could be varying the Double-Hit cards up or cards down. An additional embodiment could be "Triple-Hit" or more where the payout odds would vary such as two or three to one for declaring a "triple-hit". Double-Hit and Triple-Hit could be used in conjunction with in the same game. An example would be if the player has a very poor hand such as a total of 5 and the dealer is showing a face card. The player could decide to match his bet and "Double-Hit" or not match his bet and "Triple-Hit" in hopes of receiving a two-for-one pay out or better.

Alternate embodiments include varying the payout odds based on the number of cards taken. For example, the player could take a Double-Hit and if successful, receive a three-to-two payout of the original bet. The player would apply this strategy if the dealer has poor cards such as a 2, 3, 4, 5 or 6 showing.

CONCLUSION, RAMIFICATIONS, AND SCOPE

The invention scope includes modifying the original bet and taking a predetermined number of cards of two or greater and standing with this number of cards. Also within this scope of this invention is keeping the original bet, varying the original bet and/or receiving odds against the original bet depending on the number of cards declared. Using the terms of "Double-Hit" (two cards), "Triple-Hit" (three-cards) or "Quad-Hit" (four-cards) is envisioned to be used. This invention will add new excitement to the game of blackjack allowing the player holding a poor hand more options and chances to gamble for higher returns.

What I claim as my invention is:

1. A method of playing a blackjack-type game between a player and a dealer-banker wherein the object of the game is to score higher than the dealer yet remain under a bust number comprising the steps of:

providing at leased one deck of playing cards;

establishing numerical values to each playing card;

the player placing an original wager;

dealing two cards to each player and two cards to the dealer-banker;

the player viewing his card's sum and the face up card(s) of the dealer then deciding in accordance with gaming establishment rules whether to (1) stand, (2) split a pair, (3) double down, (4) surrender, or (5) hit a card;

including wherein if the player decides to modify his bet in exchange for being required to be dealt a fixed number of cards greater than one;

determine if the player exceeded the allowable limit such as 21 payout the winnings in accordance with preset odd ratios.

2. The method of claim 1 wherein the original bet wager can be doubled prior to receiving the additional fixed number of cards.

3. The method of claim 1 wherein the original bet wager can be cut in half prior to receiving the fixed number of draw cards.

4. The method of claim 1 wherein the number of cards is fixed at two.

5. The method of claim 1 wherein the payout odds vary by taking at least two cards.

6. The method of claim 1 wherein the number of cards is fixed at least three cards.

7. The method of claim 6 wherein various odds are offered to beat the dealer by taking a least three mandatory cards.

* * * * *